US005205097A

United States Patent [19]

Harvey

[11] Patent Number: 5,205,097

[45] Date of Patent: Apr. 27, 1993

[54] INTERLOCKING BLOCK PIER ASSEMBLY

[76] Inventor: Gary L. Harvey, 1466 Covington Cir., Fort Myers, Fla. 33919

[21] Appl. No.: 652,984

[22] Filed: Feb. 11, 1991

[51] Int. Cl.[5] ..... E02D 27/00

[52] U.S. Cl. ..... 52/294; 52/562; 248/188.2

[58] Field of Search ..... 52/293, 294, 292, 149, 52/126.1, 126.5, 562, 563, 564; 248/188.2

[56] References Cited

U.S. PATENT DOCUMENTS 1,577,906 3/1926 Hahn ..... 52/562 X
2,963,828 12/1966 Belliveau ..... 52/564

FOREIGN PATENT DOCUMENTS 150186 2/1953 Australia ..... 52/294
3926978 7/1990 Fed. Rep. of Germany ..... 52/126.1

*Primary Examiner*—David A. Scherbel
*Assistant Examiner*—Creighton Smith
*Attorney, Agent, or Firm*—William E. Noonan

[57] ABSTRACT

An interlocking block pier assembly is disclosed including a plurality of blocks for stacking in a generally vertical column to support a load thereon. Each pair of adjacent blocks is interlocked by a key formed generally radially in a first block of the pair and a complementary keyway formed generally radially in the other block of the pair for receiving the key to prevent the blocks in the pair from rotating or moving laterally relative to each other.

14 Claims, 3 Drawing Sheets

INTERLOCKING BLOCK PIER ASSEMBLY

FIELD OF THE INVENTION

This invention relates to a pier assembly and a load bearing block used to construct such an assembly. More particularly, this invention relates to a pier assembly for supporting manufactured homes and similar structures above the existing grade in a flood zone.

BACKGROUND OF THE INVENTION

To date, manufactured homes and similar structures have been supported above the ground by conventional 8"×16" masonry blocks. Such blocks are generally satisfactory for supporting structures at relatively low heights of approximately 1-2 feet. Recently, however, federal regulations have mandated that, in a flood zone, manufactured housing must be supported at a minimum elevation of 3 feet above the existing grade. Conventional masonry blocks are unsuited to meet this requirement. When stacked to a height of 3 feet, conventional blocks tend to be quite unstable. They may unexpectedly slip or shift and, under the weight of the structure, are liable to collapse.

Although interlocking masonry construction block designs have been previously employed, these systems generally exhibit a number of deficiencies. Typically, they employ an excessive amount of masonry material, e.g. concrete, which makes them rather heavy and expensive. Additionally, most interlocking blocks require very precise tolerances. Blocks that are not manufactured within such tolerances cannot be stacked securely and are unacceptable for use. Additionally, conventional block systems typically require the use of supplemental grout or fill to fasten adjacent blocks. None of the blocks which are currently known is suited for providing secure, slip-resistent support for manufactured homes and similar structures.

SUMMARY OF THE INVENTION

It is therefore an object of this invention to provide an interlocking block pier assembly that supports a manufactured home or similar structure securely and safely at a required height above the existing grade in a flood zone.

It is a further object of this invention to provide a load bearing block that exhibits satisfactory strength, but which requires a reduced amount of material so that weight and expense are reduced.

It is a further object of this invention to provide an interlocking block pier assembly that may be assembled quickly and conveniently.

It is a further object of this invention to provide an interlocking block pier assembly wherein the blocks are securely interlocked without requiring precise tolerances so that manufacturing and assembly are facilitated.

It is a further object of this invention to provide a pier assembly that employs blocks which are securely interlocked to resist shifting and movement.

It is a further object of this invention to provide a pier assembly that employs blocks that are securely interlocked without requiring supplemental grout, fill or concrete.

It is a further object of this invention to provide an interlocking block assembly that may be assembled from units of low weight that can be conveniently handled under a manufactured home by manual labor.

This invention features an interlocking block pier assembly that includes a plurality of annular blocks for stacking in a generally vertical column to support a load thereon. There are means for interlocking each pair of adjacent blocks in the column, including key means formed generally radially in a first block of the pair and complementary keyway means formed generally radially in the other block of the pair for receiving the key means to prevent the blocks in the pair from moving rotatably or laterally relative to each other.

In a preferred embodiment the key means include four key segments arranged radially at generally 90 degree intervals about the first block and the keyway means may include four keyway segments arranged radially at generally 90 degree intervals about the other block. The first block may include a generally flat lower surface in which the key means are formed and the other block may include a generally flat upper surface that engages the lower surface of the first block and in which the keyway means are formed. Typically, the key means and the keyway means have generally rounded, mating surfaces with respective dimensions such that the key means are loosely received by the keyway means.

The pier assembly may further include a solid base element that is disposed at a lower end of the column for engaging the ground. Means may be provided for interengaging the base element with a lowermost annular block in the column to prevent the lowermost block from moving rotatably or laterally relative to the base element. The means for interengaging may include a secondary key means formed in one of the lowermost annular blocks and the base element and a secondary keyway means formed in the other of the lowermost blocks and the base element for receiving the secondary key means. The secondary key means may include four key segments arranged radially at generally 90 degree intervals about the lowermost block and the secondary keyway means may include a cross-shaped keyway formed in the base element for receiving the key segments. The secondary key means and the secondary keyway means may include generally rounded mating surfaces with respective dimensions such that the secondary key means are loosely received by the secondary keyway means.

This invention also features a load bearing block that includes an annular body having generally flat upper and lower surfaces that surround an axial opening. There are key means formed in a generally radial pattern in one of the upper and lower surfaces and complementary keyway means formed in a like, generally radial pattern in the other of the upper and lower surfaces. Adjacent first and second blocks are stackable in a generally vertical load bearing column such that the key means in the first block is receivable by the keyway means in the second block to prevent adjacent blocks from moving rotatably or laterally to each other.

Preferably, the key means and the keyway means on each block extend generally from the axial opening to the outer circumferential surface of the block. The key means are preferably formed on the lower surface of the block and the keyway means are preferably formed on the upper surface.

Each of the annular blocks may include reinforcing rod means that are formed therein. Preferably, such reinforcing rod means include a spiral shaped rod.

DETAILED DESCRIPTION OF PREFERRED EMBODIMENT

Other objects, features and advantages will occur from the following description of a preferred embodiment and the accompanying drawings in which.

Figure 1:
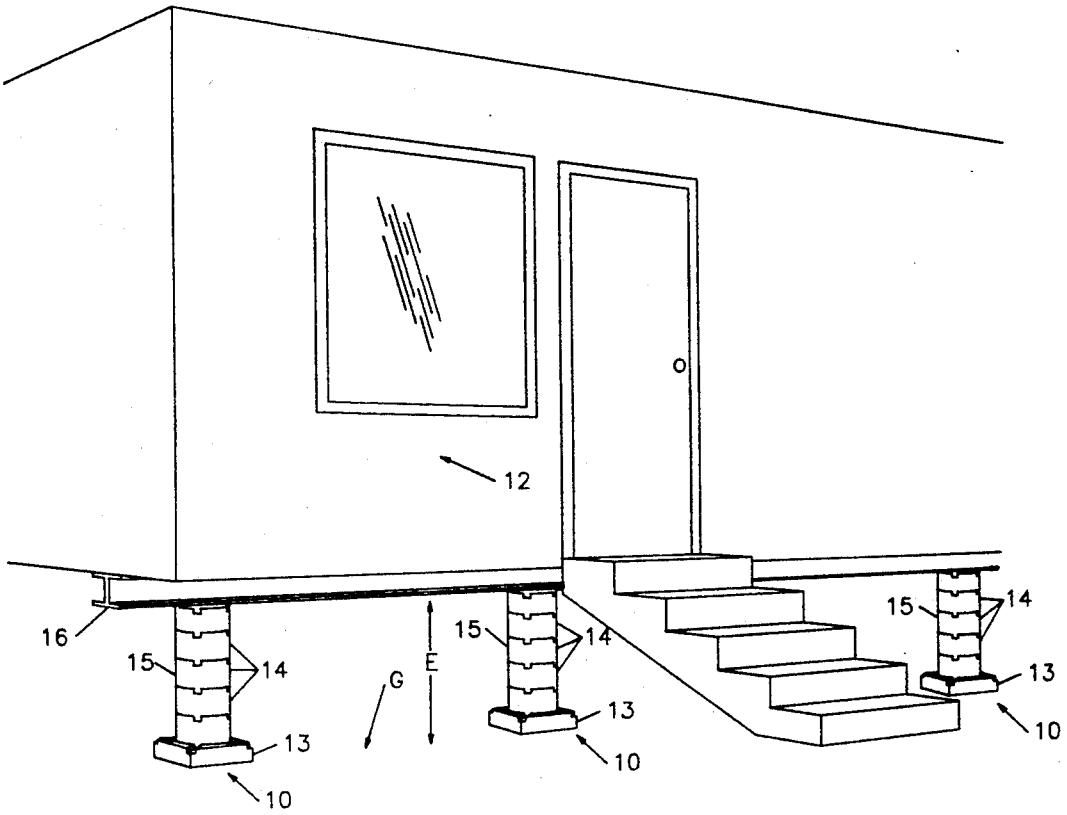
FIG. 1 is a perspective view of a manufactured home that is supported by a number of interlocking block pier assemblies, according to this invention.

An interlocking block pier assembly for manufactured homes and similar structures according to this invention, is constructed using a plurality of generally annular blocks that are preferably composed of concrete or similar masonry materials. Typically, the concrete has a minimum compressive strength of 4000 psi, although this is not a limitation of the invention. The block may be reinforced by a spiral rod or similar means. Such a reinforcing rod may be composed of, for example, ASTM A615, grade 60 steel rebar, although the specifications may be altered according to standards that are acceptable in the concrete industry. The annular blocks are stacked to form a respective pier and means are provided for interlocking adjacent blocks in each pier. Such means preferably comprise a male key that is formed in the lower surface of each block and a female keyway that is formed in the upper surface of the lower, adjacent block. Each of the key and keyway are provided with a complementary, generally radial pattern so that when they engage the adjacent blocks are prevented from shifting rotatably or laterally.

In a preferred interlocking system, the key comprises four key segments that extend from the axial opening of the block to the outer circumferential edge of the block, and are spaced apart at 90 degree intervals along the lower surface. Analogously, the keyway comprises four keyway segments that are formed in the upper surface of the lower, adjacent block at intervals of 90 degrees. Each of the keyway segments likewise extends generally from the axial opening to the outer circumferential edge of the annular block.

The pier assembly also employs a base element that is formed at the lower end of the column for supporting the stacked annular blocks. Means are provided for interengaging the lowermost annular block and the base element so that the annular blocks are prevented from moving rotatably or laterally with respect to the base element. Such means for interengaging again include a complementary key and keyway. In particular, the lowermost block element includes, on its lower surface, a radial key element, as previously described. The base element includes, on its upper surface, a complementary keyway that has a generally cross shape for receiving the key in the lowermost annular block. Typically, a square or rectangular base element is employed. This element has a lower surface area that is larger than the lower surface area of the blocks so that the weight supported by the column is evenly distributed and the pier assembly resists sinking into the ground. Annular blocks are of critical importance. That shape provides maximum structural load bearing capacity from the least amount of material. Moreover, such blocks are more convenient to maneuver into place under a manufactured home than are square or rectangular blocks.

The blocks of this invention can be manufactured in various sizes, although thicknesses of 4 or 6 inches are preferred. Typically, six such blocks are stacked on a base element to support a manufactured home approximately 3–4 feet above the existing grade. It has been determined that each such pier assembly should be capable of supporting approximately 3,500 pounds, although this level of support is not a limitation of the invention.

It has been determined that the above structure provides for secure support for manufactured homes at federally mandated elevations. The blocks in each pier assembly are securely interlocked and successfully resist shifting, slipping and rotational motion. This is accomplished without the need for grout, fill or supplemental concrete. Additionally, the weight and the expense of the pier assembly is reduced and at the same time strength is not sacrificed by employing the annular blocks. Because the complementary keys and keyways employ rounded shapes and have relatively loose fits, the blocks are quickly and conveniently engaged and interlocked. Tight tolerances are not required and manufacturing and assembly are facilitated considerably.

There is shown in FIG. 1 a plurality of interlocking block pier assemblies 10 for supporting a manufactured home 12 above the existing grade G of a flood zone. Pier assemblies 10 are arranged in rows and spaced apart at required intervals (e.g. 7 or 8 feet) along house 12. In a typical "single wide" manufactured home, a pair of forward and rearward rows of pier assemblies 10 may be provided. If the home is a standard 32 feet long and 12 feet wide, five pier assemblies 10 are typically used in a row beneath the forward portion of the house and a second row of five pier assemblies are provided longitudinally along the rear of the house. In such cases, a distance of approximately 7 feet is provided between each adjacent pair of pier assemblies in a row. In a "double-wide" manufactured home, four rows of pier assemblies are typically utilized. The required number of pier assemblies and the spacing between them may be varied according to the required application.

Each pier assembly 10 includes a base element 13 that is placed on the grade or ground G and a plurality of annular blocks 14 that are stacked upon base element 13 to form a generally vertical column 15. A I-beam frame 16 that depends from the bottom of house 12 extends across the uppermost block 14 in each column of a respective row such that the house 12 is supported by the pier assemblies 10 at a desired elevation E above the grade G.

Figure 2:
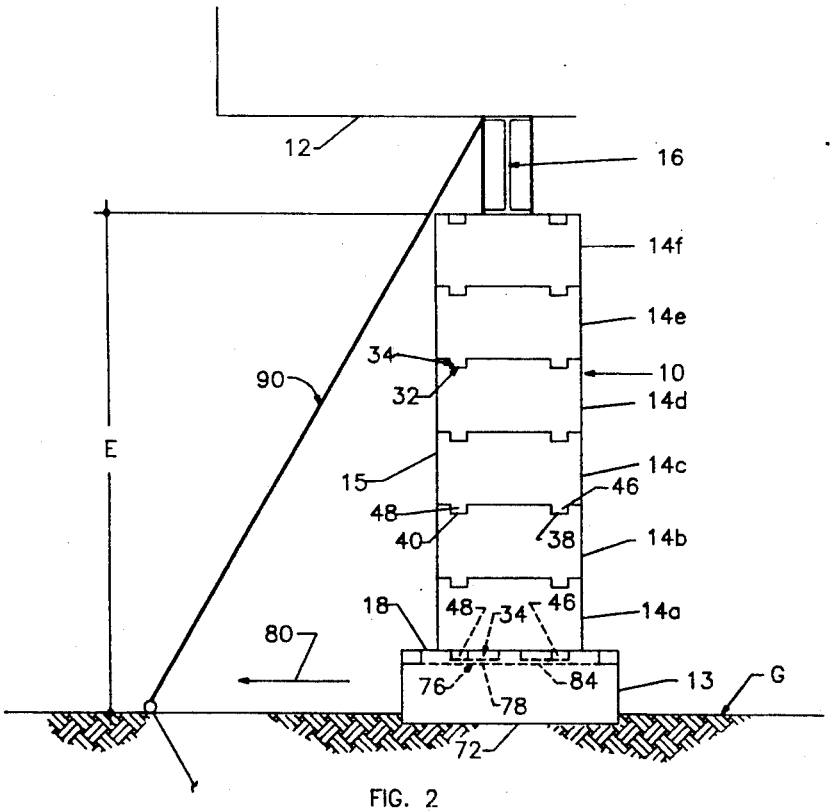
FIG. 2 is an elevational side view of a single pier assembly.
Figure 3:
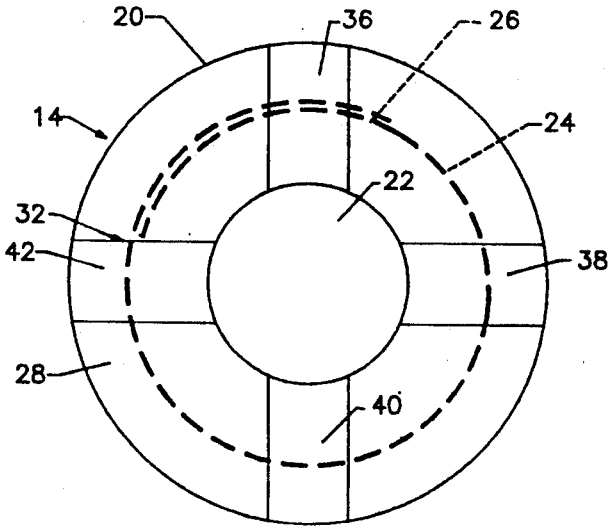
FIG. 3 is a top plan view of a preferred load bearing block used in the pier assembly.
Figure 4:
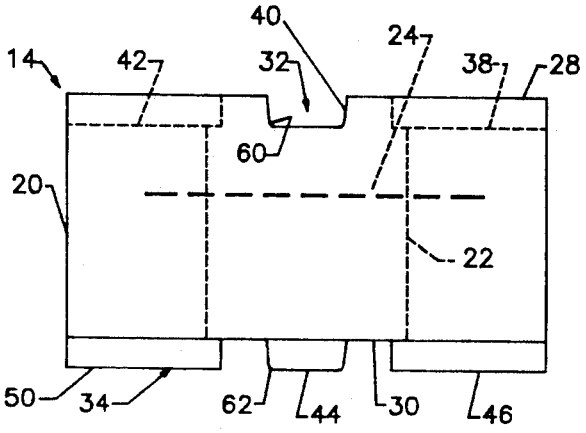
FIG. 4 is an elevational view of the block of FIG. 3.
Figure 5:
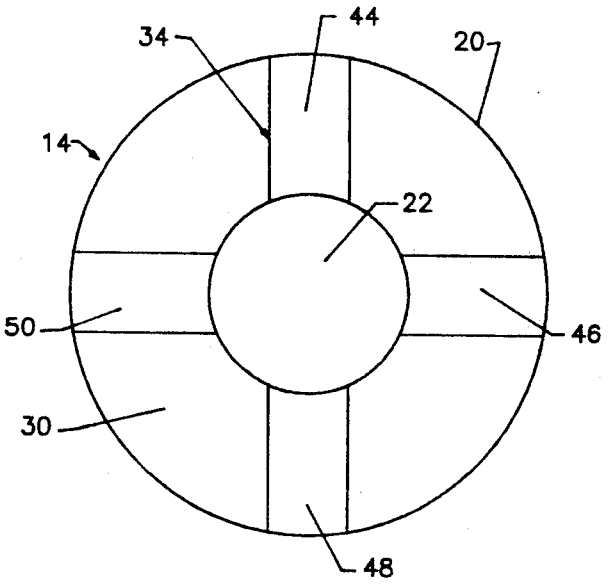
FIG. 5 is a bottom plan view of the block of FIG. 3.

As shown in FIG. 2, each column 15 includes six virtually identical interlocking load bearing blocks **14*a*–14*f* that are stacked on a generally flat upper surface 18 of base element 13. A representative block 14 is shown in FIGS. 3–5. The block, which is typically composed of concrete or similar material, has a generally annular body including an outer circumferential surface 20 and an axial opening 22. A spiral reinforcing rod 24 is disposed annularly within block 14. The rod typically has an overlap 26 of approximately 12 inches. Each block 14 has a flat upper surface 28, FIGS. 3 and 4, and a flat lower surface 30, FIGS. 4 and 5. Keyway means 32 are formed radially in upper surface 28 and complementary key means 34 are formed on lower surface 30**.

More particularly, keyway means 32 include four keyway segments 36, 38, 40 and 42 that extend radially from axial opening 22 to outer circumferential edge 20. The keyway segments 36, 38, 40 and 42 are disposed at 90 degree intervals about upper surface 20 so that the keyway presents a generally cross-shaped radial pattern. Similarly, key means 34 includes four key segments 44, 46, 48 and 50 that extend along the bottom surface 30 of block 14 from axial opening 22 to outer circumferential surface 20. The key may have a width of 2 inch and a depth of ¾ inches. The complementary keyway may have a depth of 2⅛ inch and a width of 1 inch. Such dimensions are for illustration only, however and are not a limitation of the invention.

As best shown in FIG. 4, each of the keyway segments of key 32 has slightly rounded corners 60 and, similarly, each of the key segments of key 34 has rounded corners 62. Rounded edge 62 may have a radius of approximately ⅜ inch, although other dimensions may be utilized. Such complementary rounded mating surfaces permit respective keys and keyways on adjacent blocks to engage and interlock, as described below, even if the dimensions of the keys and keyways vary slightly. Precise tolerances are not required, blocks are not wasted and constructing the pier assembly is facilitated greatly.

Figure 6:
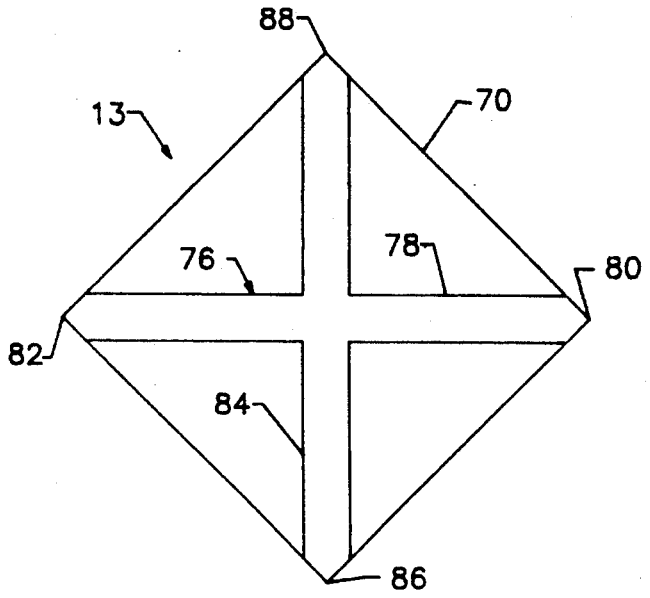
FIG. 6 is a top plan view of a preferred base element used in the pier assembly.
Figure 7:
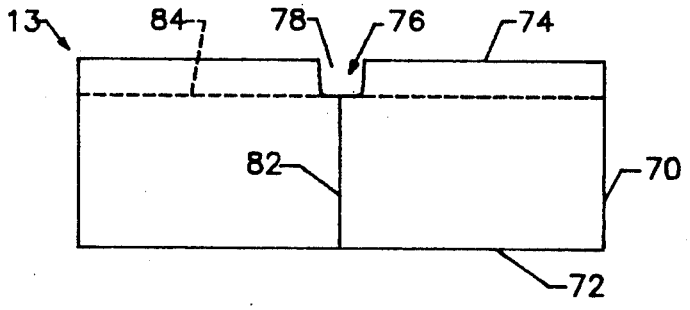
FIG. 7 is an elevational side view of the base element of FIG. 6.

A preferred base element 13 is shown in FIGS. 6 and 7. The base element includes a rectangular body 70 having a generally flat lower surface 72 that engages the ground and a generally flat upper surface 74 on which the column 15 of blocks 14 is supported. A cross-shaped keyway 76 is formed in upper surface 74. More particularly, keyway 76 includes a first segment 78 that extends between corners 80 and 82 of block 70, and a second segment 84 that extends between corners 86 and 88.

To construct pier assembly 10, the grade G is first cleaned and leveled, as required. Base element 13 is then placed on the grade G, as shown in FIG. 2, so that one of its four sides faces forwardly in the direction of arrow 80. The lowermost annular block **14*a* is then mounted on base element 13. Block 14*a* is manipulated so that the key means 34 formed on lower surface 30 thereof are aligned with the keyway 76 of the base element 13. The key 34 in block 14*a* is then engaged with keyway 76 of base element 13 so that block 14*a* and element 13 are interlocked. For example, key segment 48 is received in keyway segment 78, and key segment 46 is received in keyway segment 84. Similarly, although not shown in FIG. 2, key segment 44 is received in keyway segment 82, and key segment 50 is received in keyway segment 88. Alternatively, the block 14 may be arranged at other orientations wherein key 34 is aligned with keyway 76. In any case, with the key 34 and keyway 76 aligned and interengaged, the complementary radial, cross-like shapes of base element 13 and block 14*a*** prevent them from moving rotatably relative to each other.

The remaining blocks **14*b*–14*f* are stacked above block 14*a* in a similar manner. First, the key means 34 on the lower surface 30 of block 14*b* is aligned with the complementary keyway 32 on the upper surface 28 of block 14*a*. Key 34 is fitted into keyway 32 so that blocks 14*a* and 14*b* are interlocked. The remaining blocks 14*c*–14*f* are then stacked one upon the other in a similar manner. In each case, the key 34 on the lower surface 30 of the upper block engages the keyway 32 in the upper surface 28 of the lower adjacent block. For example, as shown in FIG. 2, key segment 48 is received in keyway segment 40 and key segment 46 is received in keyway segment 38. Likewise, although not shown in FIG. 2, key segment 44 is received by keyway segment 36 and key segment 50 is received by keyway segment 42. The blocks may be re-oriented such that any one of the key segments is received by any one of the keyway segments. In this manner, each adjacent pair of blocks 14** interlock and the blocks are prevented from slipping or rotating relative to one another.

When all of the pier assemblies 10 have been constructed in the above manner, the frame 16 of manufactured home 12 is mounted on the pier assemblies such that the frame extends across the uppermost annular block **14*f* in each column. A shim or similar means may be employed between frame 16 and block 14*f*** to provide a desired degree of leveling.

By disposing the keyway in the base element 13 such that the keyway segments 78 and 84 intersect the corners of the base element, the blocks **14*a*–14*f* are positioned so that the keyways 32 extend diagonally, and not longitudinally beneath the T-beam 16. As a result, the T-beam rests primarily upon solid block and does not extend longitudinally across the keyways 32. This provides for increased structural support. At the same time, a linear side of the base element 13 faces forwardly in the direction of arrow 80 so that pier assembly 10 presents an aesthetically pleasing appearance. The appearance would be less attractive if the corners of the base element 13** were to face in a forward direction.

A frame tie strap 90 may be secured in a conventional manner between frame 16 and ground G. This improves the support provided to the manufactured home 12 and helps the home to resist wind forces that may be exerted thereon.

Accordingly, this invention provides simplified and yet greatly improved structural support for manufactured homes and similar structures. Secure, slip resistent support is achieved and at the same time material is eliminated so that weight and expense are saved. The use of annular blocks interlocked by radial, cross-shaped keys and keyways provides secure support and slip resistance, without requiring the use of supplementary grouts or concrete to interlock the blocks. This further saves time, effort and expense. The pier assembly meets federal flood zone regulations and provides a much improved foundation for manufactured homes and similar structures.

Although specific features of this invention are shown in some drawings and not others, this is for convenience only, as each feature may be combined with any or all of the other features in accordance with the invention. Other embodiments will occur to those skilled in the art and are within the following claims.

What is claimed is:

1. An interlocking block pier assembly comprising:

a plurality of annular blocks for stacking in a generally vertical column to support a load thereon; and means for interlocking each pair of adjacent blocks in said column including key means formed generally radially in a first block of said pair and complementary keyway means formed generally radially in the other block of said pair for receiving said key means to prevent said blocks in said pair from moving rotatably or laterally relative to each other; said key means including four key segments arranged radially at generally 90 degree intervals about said first block and said keyway means including four keyway segments arranged radially at generally 90 degree intervals about said other block.

2. The pier assembly of claim 1 wherein said block includes a generally flat lower surface, in which said key means is formed and wherein said other block includes a generally flat upper surface that engages said lower surface of said first block and in which said keyway means is formed.

3. The pier assembly of claim 1 in which said key means and keyway means have generally rounded mating surfaces with respective dimensions such that said key means are loosely received by said keyway means.

4. The pier assembly of claim 1 further including a solid base element disposed at a lower end of said column for engaging the ground and means for interengaging said base element with a lowermost annular block in said column to prevent said lowermost block from moving rotatably or laterally relative to said base element.

5. The assembly of claim 4 in which said means for interengaging include secondary key means formed in one of said lowermost annular blocks and said base element and secondary keyway means formed in the other of said lowermost block and said base element for receiving said secondary key means.

6. The assembly of claim 5 in which said secondary key means include means four key segments arranged radially at generally 90 degree intervals about said lowermost block and said secondary keyway means include a cross-shaped keyway formed on said base element for receiving said key segments.

7. The assembly of claim 1 in which each said annular block includes reinforcing rod means that are formed therein.

8. The assembly of claim 7 in which said reinforcing rod means includes a spiral reinforcing rod.

9. The pier assembly of claim 1 in which each annular block includes generally flat upper and lower surfaces.

10. The pier assembly of claim 9 in which said key means are on said lower surface of said block and said keyway means are on said upper surface of said block.

11. An interlocking block pier assembly comprising:

a plurality of annular blocks for stacking in a generally vertical column to support a load thereon;

means for interlocking each pair of adjacent blocks in said column including key means formed generally radially in a first block of said pair and complementary keyway means formed generally radially in the other block of said pair for receiving said key means to prevent said blocks in said pair from moving rotatably or laterally relative to each other; and a solid base element disposed at a lower end of said column for engaging the ground and means for interengaging said base element with a lowermost block in said column to prevent said lowermost block from moving rotatably or laterally relative to said base element, said means for interengaging including secondary key means formed in one of said lowermost annular block and said base element and secondary keyway mens formed on the other of said lowermost block and said base element for receiving said secondary key means; said secondary key means including four key segments arranged radially at generally 90 degree intervals about said lowermost block and said secondary keyway means including a cross-shaped keyway formed on said base element for receiving said key segments.

12. The pier assembly of claim 11 in which said key means include four key segments arranged radially at generally 90 degree intervals about said first block and said keyway means include four keyway segments arranged radially at generally 90 degree intervals about said other block.

13. The assembly of claim 11 in which said secondary key means and secondary keyway means include generally rounded mating surfaces with respective dimensions such that said secondary key means is loosely received by said secondary keyway means.

14. An interlocking block pier assembly comprising:

a plurality of annular blocks for stacking in a generally vertical column to support a load thereon;

means for interlocking each pair of adjacent blocks in said column including key means formed generally radially in a first block of said pair and complementary keyway means formed generally radially in the other block of said pair for receiving said key means to prevent said blocks in said pair from moving rotatably or laterally relative to each other; and a spiral reinforcing rod formed in each annular block.

* * * * *